United States Patent [19]

Gammerler

[11] Patent Number: 4,781,368

[45] Date of Patent: Nov. 1, 1988

[54] METHOD OF AND APPARATUS FOR CHANGING THE CONVEYING SPEED OF SHINGLED PAPER PRODUCTS

[76] Inventor: Gunter Gammerler, D-8021 Icking, Ichoring 44, Fed. Rep. of Germany

[21] Appl. No.: 120,208

[22] Filed: Nov. 6, 1987

Related U.S. Application Data

[63] Continuation of Ser. No. 823,305, Jan. 28, 1986, abandoned.

[30] Foreign Application Priority Data

Jan. 29, 1985 [DE] Fed. Rep. of Germany ..... 3502897

[51] Int. Cl.[4] ..... B65H 5/34

[52] U.S. Cl. ..... 271/270; 271/274; 271/203; 271/182

[58] Field of Search ..... 271/114, 120, 270, 314, 271/202, 272–274, 275, 203, 150–151, 182, 198; 198/623

[56] References Cited

U.S. PATENT DOCUMENTS

| | | | |
|---|---|---|---|
| 2,810,575 | 10/1957 | Holmer | 271/105 |
| 3,084,931 | 4/1953 | Hanson | 271/272 |
| 3,315,956 | 4/1967 | Lyman | 271/202 |
| 3,459,420 | 8/1969 | Hartwork | 271/150 |
| 3,822,793 | 7/1974 | Stobb | 271/203 |
| 3,884,102 | 5/1975 | Faltin . | |

FOREIGN PATENT DOCUMENTS

| | | |
|---|---|---|
| 0075121 | 3/1983 | European Pat. Off. . |
| 2114865 | 10/1972 | Fed. Rep. of Germany . |
| 2141340 | 2/1973 | Fed. Rep. of Germany . |
| 2326563 | 12/1974 | Fed. Rep. of Germany . |

*Primary Examiner*—H. Grant Skaggs
*Attorney, Agent, or Firm*—Paul L. Sjoquist

[57] ABSTRACT

A method of and an apparatus for changing the conveying speed of shingled paper products after each of the individual products has been seized and accelerated, whereby the products are seized on its upper surface or its lower surface as a result of a cyclically recurring contact pressure exerted vertically or approximately vertically on the latter.

12 Claims, 2 Drawing Sheets

Figure 1:
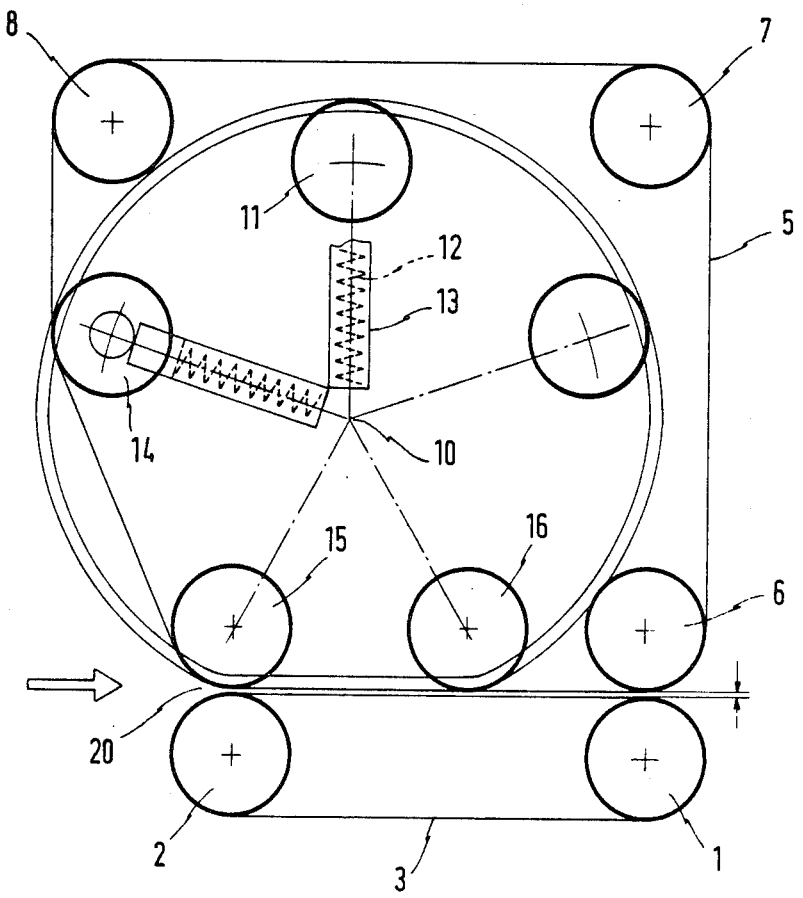

METHOD OF AND APPARATUS FOR CHANGING THE CONVEYING SPEED OF SHINGLED PAPER PRODUCTS

This is a continuation of co-pending application Ser. No. 823,305 filed on Jan. 28, 1986 now abandoned.

This invention relates mainly to a method of changing the conveying speed of shingled products, particularly paper, supplied on a belt conveyor or the like, after each of the individual products has been seized and accelerated.

After manufacturing of printing products, e.g. in rotary printing machines, there are obtained folded paper products which include at least four sides and are to be supplied to further treatment steps, e.g. trimming, stacking, stapling or the like.

Such printing machines supply e.g. 40,000 shingled paper products per hour which makes it necessary that for avoiding piling up the following treatment steps have always to operate at constant speed, this involving with regard to the paper products running in in shingled form great difficulties, especially since trimming of the paper products is to be performed not only at two sides opposing each other but also at at least one transverse side so that a guiding device has to be provided between the two cutting units. Since cutting of shingled paper products—same can also be individual cardboard sheets or paper sheets which, however, should have an inherent stiffness strong enough to permit maintaining of the high conveying speeds—usually can be made only when the paper products supplied in shingled form are drawn apart, it is necessary to draw the products apart to cause them to lay flat, or bring to one level with the conveying plane by individually seizing and individually accelerating each product.

Since as is known the paper products cannot be put down after having been supplied by the supply star to the conveyor belt, exactly enough to cause the distances between the edges of the shingled products or the products to be equally long, there are produced during shingling errors of up to ±50% at a distance of e.g. 30 mm between the edges of the shingled products.

It is true, there is already known a method of and a device for accelerating the shingled products for the purpose of drawing the paper products apart by seizing each respective product at its free edge and accelerating it at a speed higher than the initial conveying speed.

The conventional way used is that after drawing apart of the products and any required treatment, e.g. trimming of the products, the former condition is reestablished since the initial conveying speed is to be maintained.

As a result of twice the speed of the individual products to be drawn out, the respective error in distance between the edges of the shingled products is doubled.

This invention therefore is based on the problem to provide a method of and an apparatus for causing the error to remain unchanged at varying distances between the edges of the shingled products.

This problem has been solved by the measure that inventively the shingled products are seized on its upper surface or its lower surface as a result of a contact pressure exerted vertically or nearly vertically thereon.

It is achieved thereby that the individual product is seized between its free edge and the free edge of the following product at a point by which the respective error is taken into account.

It is known that when shingling of the paper products is being released, one can proceed vice versa, i.e. instead of accelerating one decelerates so that when a respective method is used, release of shingling takes place only while taking into account the original errors; i.e. the errors proportional to the speed are reduced.

Preferably, the shingled products are accelerated until they are completely brought to the level.

The contact pressure can be produced by intermittently lowered rollers, rolls or the like. Accelerating of the shingled products can also be achieved by a continuous conveyor driven approximately parallel to and in the direction of the conveying direction.

In an apparatus which is particularly useful for carrying out the above described method, there are provided a continuous conveyor including a contact pressure device running punctually or transversely to the conveying direction in lines, and an abutment associated to said device.

The continuous conveyor can be guided about at least three, preferably four guiding rollers or rolls. The contact pressure device usefully consists of at least three, preferably at least five, rollers, rolls or the like rotatable about a common axis and arranged radially, and the star can be rotatable at a rotational speed differing from the speed of the continuous conveyor.

The rollers, rolls or the like are preferably distributed on the circumference at the same arcuate angle such that the roller, roll or the like following in circumferential direction seizes the next-following shingled product. The rollers, rolls or the like can be resiliently held in radial direction.

The continuous conveyor usefully is constituted by a belt of a width of more than 50 cm having an adhesive surface or by several narrow belts.

At least on one side of the continuous conveyor, there can be provided a curved plate or the like for determining the course of the rollers, rolls or the like. The circular path of the rollers, rolls or the like of the star includes straight section extending parallel to the running direction.

In an especially preferred embodiment, the rollers, rolls or the like of the star have the same width as the guiding rolls or rollers of the continuous conveyor.

Consequently, at least two, preferably three, rollers or rolls of the star can simultaneously also be used as guiding rollers of the continuous conveyor; in this case, the rollers or rolls of the star are self-evidently not driven independently; the continuous conveyor is driven in the customary way; one can use as abutment if appropriate a continuous conveyor rotating over two guiding rolls or rollers, which conveyor is not independently driven, if appropriate.

The drawing presents an exemplifying embodiment of the invention which hereinafter will be described in more detail; it is shown in FIG. 1 a schematic representation of a side view on an embodiment, and FIG. 2 a similar view including an additional member.

The products supplied by such a rotary wheel printing machine can be folded signatures, individual sheets or stacks of sheets, provided that they can be conveyed in shingled form by means of customary conveying means, e.g. pairs of endless conveyor belts, at high speed.

Rotary wheel printing machines in which are also made foldings deliver e.g. 40,000 signatures per hour in shingled form.

A distance between the edges of the overlapping products of 80 mm has proved to be customary, independent of the length of the individual products. This customary distance varies, however, as a result of the slightly irregular supply of the supply star behind the rotary printing machine or a feeding machine, and therefore one has to take into account a failure of about 50%, i.e. 40 mm. For avoiding this error to be enlarged on acceleration of the individual overlapping parts during extension of the product stream, the apparatus described below provides for the absolute error to be kept constant.

An endless belt 3 guided over two guiding rolls 1 and 2 serves as an abutment for a continuous conveyor provided as an endless belt 5 and in case of the embodiment shown includes three guiding rolls 6,7,8 of which one can be driven.

The slightly elastic endless belt 5 in the shown embodiment has a width of about 50 to 55 cm and has an adhesive surface. Instead of the individual wide belt, one can of course use a number of narrow belts to rotate over the guiding rolls.

There is arranged within the endless belt 5 a star rotating about an axis 10 and having free-running rolls 11, 14, 15, 16, 17; in the present case, there are provided five rolls.

The star provided with the five free running guiding rolls engages each time by means of two or three guiding rolls the inner side of the endless conveyor belt 5.

The individual rolls 11 of the star are attached each to a housing 13 provided with a spring 12 to permit resiliency of said rolls in radial direction.

As can be seen from FIG. 1, there are provided straight sections of the continuous conveyor which extend from the free-running roll 14 to the corresponding free-running guiding roll 15 and from there to the corresponding guiding roll 16. The straight-lined advancing of the continuous conveyor to the point at which the shingled products run in 20 takes place at an angle of about 60° relative to the horizontal line, to determine more exactly the contact line between the two endless belt 3 and 5.

The free-running rolls 11,14,15 and 16 include between them an arcuate angle which is adapted to the distance between the products.

When the stream of shingled products runs in at a speed of about 50 l m/min, the endless belt 5 is driven at a speed of 150 m/min, i.e. about three times the first mentioned speed, so as to extend the product stream.

The star having the five rolls 11, 14 to 17, however, rotates at a speed corresponding to the rotational speed of the supply star during production of the stream of shingled imbricted products, i.e. 50 m/min. Rotation of the star about the axis 10 by a drive means M is shown schematically in FIG. 2.

The use of these speed ratios results in that drawing apart of the imbricated products is brought about at three times higher the initial speed, but by means of the contact pressure rolls 11 and 14–17 each individual product is seized always while being equally spaced from the preceding product and the following product. It is achieved by this "constant" distance between the individual products that independent of the possible source of error in case of a following shingling only the original errors have to be taken into account.

Figure 2:
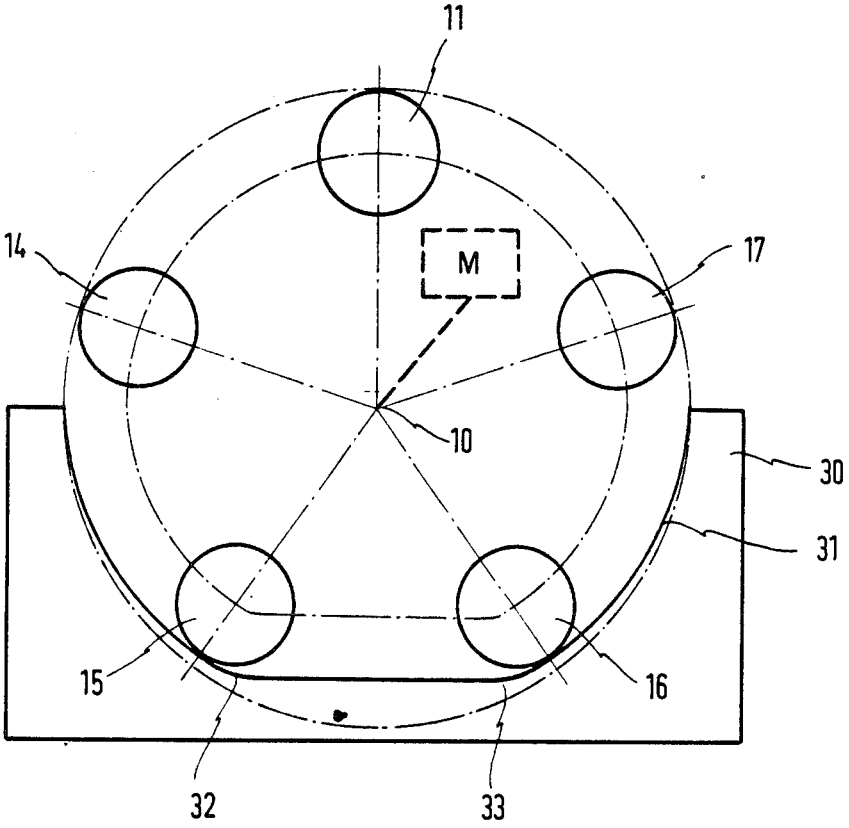

As shown in FIG. 2, there is provided one curved plate 30 laterally from each of the conveyor belts 3 and 5 for determining the course of the laterally protruding, free-running rolls 11 or 14 to 17.

Whereas the rolls in the upper part of their region of rotation are rotated in fully extended condition, they are forced by the curvature 31 in the curved plate in the lower third inwardly against the force of the springs 12, the respective product being seized at the bending point 32.

When the endless belt has passed the curvature 33, it is released from the product, whereupon then the next-following product is seized by the next roll.

Though according to a modified embodiment the star can be provided with five guiding rolls and the continuous conveyor can be provided with four guiding rolls, it is not necessary that the guiding rolls of the star engage the endless belt—as indicated above—by means of at least two rolls, but there has to be used for contact pressure only one of the guiding rolls of the star.

It is furthermore possible instead of the radial spring housing to mount in each of the guiding rolls of the star one guiding means which by the force of the spring (leg spring is urged outwardly.

Instead of the continuous conveyor which is in the form of an abutment, one can also use a second star including a continuous conveyor.

I claim:

1. An apparatus for changing the conveying speed of shingled paper products aligned along a moving belt conveyor or the like, comprising a second moving belt arranged about a plurality of rollers, the plurality of rollers being each radially displaced about a common axis, and means for rotating the common axis; said common axis and said plurality of rollers being positioned relative to said shingled paper products to cause said second belt to contact said shingled products.

2. The apparatus of claim 1, further comprising a compression spring means for supporting each of said rollers and for permitting radial movement of said rollers toward said common axis.

3. The apparatus of claim 2, wherein said rollers are displaced about said common axis at equal arcuate angular positions.

4. The apparatus of claim 3, wherein said plurality of rollers further comprise five rollers.

5. The apparatus of claim 3, further comprising a curved circumferential plate positioned along a portion of a circumference relative to said common axis, and supporting and guiding said rollers over at least a portion of the rotational path of said rollers.

6. The apparatus of claim 5 wherein said curved circumferential plate for supporting and guiding said rollers further comprises a straight section adjacent said moving belt conveyor.

7. The apparatus of claim 6, wherein said plurality of rollers further comprise five rollers.

8. A method of changing the conveying speed of shingled paper products and the like having partially overlapping surfaces, and being conveyed over a first moving belt conveyor or the like, comprising the steps of seizing a shingled first product by applying a substantially vertical contact pressure against the first product non-overlapped surfaces by a second moving belt, accelerating the first product in the direction of the first moving belt conveyor or the like while maintaining the substantially vertical contact pressure across said second moving belt for a predetermined time over a predetermined path in the conveying direction, releasing the substantially vertical contact pressure, and repeating the foregoing steps for the next and subsequent products.

9. The method of claim 8, wherein the step of releasing the substantially vertical contact pressure further comprises releasing the substantially vertical contact pressure at a position where the product is no longer shingling another product.

10. A method according to claim 8, characterized in that the shingled products are each accelerated until they are completely brought to the same level as the moving belt conveyor or the like.

11. A method according to claim 10, characterized in that the contact pressure is produced by intermittently lowered rollers, rolls or the like.

12. A method according to claim 11, characterized in that acceleration of the shingled products is produced by a continuous conveyor driven approximately in parallel and in the direction of the conveying direction.

* * * * *